United States Patent [19]

Mitzutani

[11] Patent Number: 4,609,276

[45] Date of Patent: Sep. 2, 1986

[54] IMAGE FORMATION APPARATUS

[75] Inventor: Morikazu Mitzutani, Kawasaki, Japan

[73] Assignee: Canon Kabushiki Kaisha, Tokyo, Japan

[21] Appl. No.: 690,412

[22] Filed: Jan. 10, 1985

Related U.S. Application Data

[63] Continuation of Ser. No. 404,523, Aug. 2, 1982, abandoned.

[30] Foreign Application Priority Data

Aug. 7, 1981 [JP] Japan ..... 56-124538

[51] Int. Cl.[4] ..... G03G 15/00

[52] U.S. Cl. ..... 355/3 R; 355/3 DR; 355/3 SH

[58] Field of Search ..... 355/3 R, 3 DR, 3 SH, 355/16, 3 BE, 3 TR

[56] References Cited

U.S. PATENT DOCUMENTS 3,666,363 5/1972 Tanaka et al. ..... 355/17
3,985,436 10/1976 Tanaka et al. ..... 355/8
4,254,202 3/1981 Matsumoto et al. .
4,327,992 5/1982 Babicz ..... 355/3 DR X
4,335,950 6/1982 Gunzelmann et al. ..... 355/3 R
4,376,579 3/1983 Wakao ..... 355/3 DR
4,378,154 3/1983 Hoffman ..... 355/3 SH X
4,386,838 6/1983 Hirabayashi et al. ..... 355/3 DR

FOREIGN PATENT DOCUMENTS 55-19936 5/1980 Japan .
57-189166 11/1982 Japan .

*Primary Examiner*—Arthur T. Grimley
*Assistant Examiner*—J. Pendegrass
*Attorney, Agent, or Firm*—Fitzpatrick, Cella, Harper & Scinto

[57] ABSTRACT

An image formation apparatus includes an image bearing member, process device acting on the image bearing member, a process unit having the image bearing member and the process device integrally and removably mountable on the body of the apparatus, guide for guiding a sheet toward the image bearing member, and a support for supporting the guide so as to position the guide in relation to the process unit.

47 Claims, 16 Drawing Figures

IMAGE FORMATION APPARATUS

This application is a coninuation of application Ser. No. 404,523 filed Aug. 2, 1982, now abandoned.

BACKGROUND OF THE INVENTION

1. Field of the Invention

This invention relates to an image formation apparatus having an image bearing member and process means acting on the image bearing member.

2. Description of the Prior Art

Description will hereinafter be made with an electrophotographic copying apparatus taken as an example of the image formation apparatus.

In the electrophotographic copying apparatus, interchange of the photosensitive drum has often been done by removing or loading the photosensitive drum axially thereof by utilization of the drum shaft because of the ease with which the drum is mounted or dismounted or the accuracy of the mounting or dismounting of the drum is obtained. Also, a core positioning plate has been used to prevent the photosensitive drum from slipping out of the apparatus body after it has been loaded into the apparatus body, to control the axial position of the photosensitive drum and to accurately position the photosensitive drum relative to the optical system. Around the photosensitive drum, various members such as a developing device, a cleaner, a transfer paper transportation guide and a separator for separating transfer paper from the photosensitive drum are disposed in proximity to or in contact with the drum in accordance with the conditions of the process. Therefore, in order to mount or dismount the photosensitive drum with respect to the apparatus body, it has been necessary to release these members so that they withdraw from the photosensitive drum. If the mounting or dismounting of the photosensitive drum is effected without releasing these members, the surface of the photosensitive drum or the members may be injured or damaged.

Therefore, it has heretofore been practised to dispose an operating member for releasing the members in front of the aforementioned core positioning plate and to prevent the core positioning plate from slipping off unless the members are released, thereby preventing any malfunction. In this case, the malfunction can be prevented, but the operation of interchanging the photosensitive drum has been very cumbersome because it has involved the steps of releasing the members, thereafter removing the core positioning plate, and then mounting or dismounting the drum. For the purpose of preventing the malfunction, it has also been practised to make the operating member for releasing the members large in size and dispose it in the core positioning plate removal path, but this has led to an increased number of parts.

Recently, as shown in U.S. Pat. No. 3,985,436, there has been proposed an image formation apparatus in which, for example, a photosensitive drum, a developing device, a cleaner, a charger, etc. are constructed as a process unit and these may be interchanged at a time during the interchange of the photosensitive drum. In the case of such apparatus, the developing device or the cleaner need not be released even during the interchange of the photosensitive drum. However, it is difficult from the viewpoint of jam treatment to make the transfer paper transportation guide integral with the process unit and, as has heretofore been done, it is necessary to release the transfer paper transportation guide from the vicinity of the photosensitive drum during the interchange of the process unit. Thus, this image formation apparatus still suffers from the above-noted problems.

SUMMARY OF THE INVENTION

The present invention contributes an image formation apparatus which overcomes the foregoing difficulties and disadvantages and facilitates interchanging of an image bearing member such as a photosensitive drum. More specifically, the invention contemplates an image formation apparatus having an image bearing member, process means for acting on the image bearing member, a process unit including the image bearing member and the process means removable and totally separable from a body of the apparatus, movable guide means for guiding a transported sheet toward the image bearing member, and support means for supporting the movable guide means so as to position the guide means in relation to the process unit when the process unit is mounted in an operative position.

DESCRIPTION OF THE PREFERRED EMBODIMENTS

The invention will hereinafter be described in greater detail with respect to some embodiments thereof.

Figure 1:
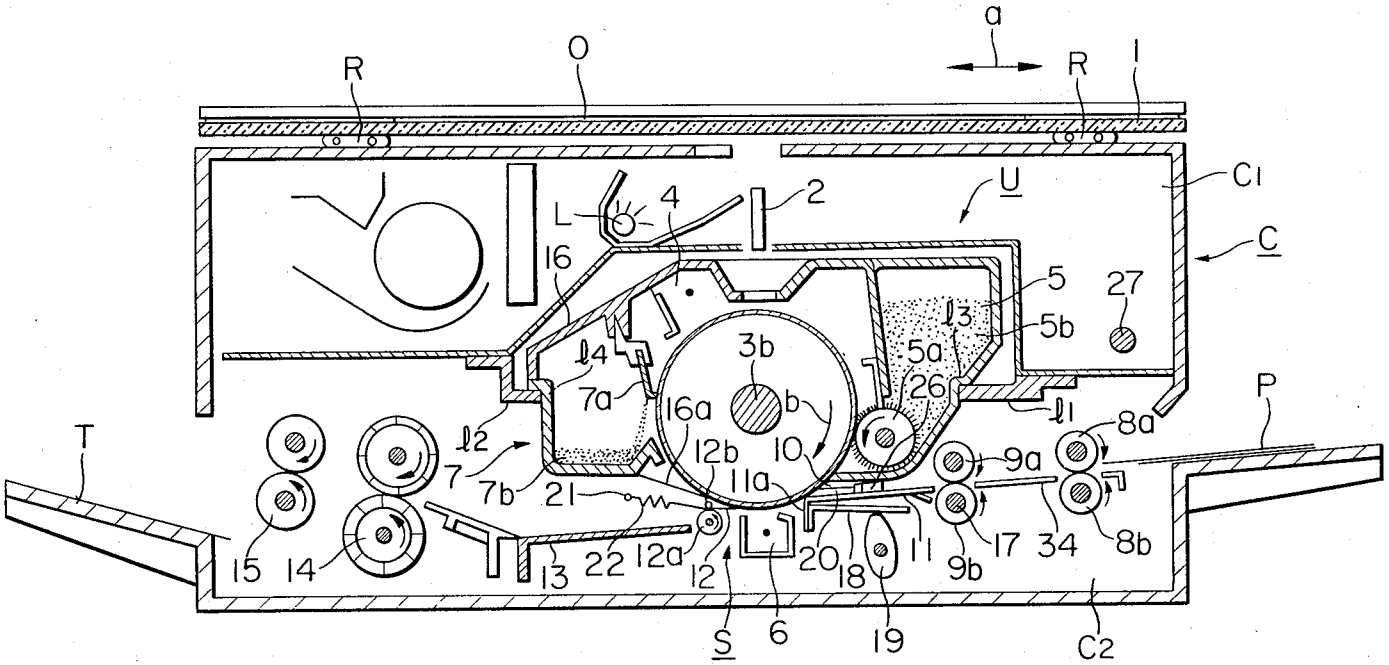
FIGS. 1 and 2 are cross-sectional views of a copying apparatus to which an embodiment of the present invention is applied.

Referring to FIG. 1, it shows a cross-sectional view of a copying apparatus body to which an embodiment of the present invention is applied. In FIG. 1, reference numeral 1 designates an original carriage formed of a transparent material such as glass and reciprocable on rails R in the direction of arrow a. Reference numeral 2 denotes a short-focus small-diameter imaging element array. An original O placed on the original carriage 1 is illuminated by an illuminating lamp L and the reflected optical image thereof is slit-projected upon a photosensitive drum 3 by the array 2. The drum 3 has its peripheral surface covered with a photosensitive layer 3*a* and is rotatable about a shaft 3*b* in the direction of arrow b. A charger 4 uniformly charges the photosensitive drum 3 covered with the photosensitive layer 3*a* of zinc oxide, for example. The photosensitive drum 3 uniformly charged by the charger 4 is subjected to image exposure by the element array 2, whereby an electrostatic image corresponding to the image of the original O is formed on the drum 3. The electrostatic image is then developed into a visible image by a developing device 5 comprising a magnet roller 5*a* and a toner reservoir 5*b*. Thereafter, the visible image is transferred onto a sheet P by a transfer charger 6. Any toner remaining on the photosensitive drum 3 is removed by a cleaner 7. The cleaner 7 comprises a rubber blade 7*a* and a toner reservoir 7*b*.

The sheet P is fed toward the drum 3 by upper and lower paper feeding rollers 8*a* and 8*b*, a guide 34 and upper and lower register rollers 9*a* and 9*b* rotated in synchronism with the image on the photosensitive drum 3 while being guided by an upper transfer guide 10 and a lower transfer guide 11. The sheet P thus fed into contact with the drum 3 has the toner image transferred thereto while one side edge thereof is spaced apart from the drum 3 by a separating belt 12 during the image transfer, and after the image transfer, the sheet P is guided away from the photosensitive drum 3 by the belt 12. The sheet P thus guided away from the drum 3 is nipped between and conveyed by a rotating separating roller 12*a* and a roller 12*b* following the rotation of the separating roller 12*a*, whereby the sheet P is separated from the drum 3. That is, the sheet P is separated from the peripheral surface of the drum 3 by separator means S having the separating belt 12 and the separating roller 12*a*.

The sheet P separated from the drum 3 is guided to a fixing device 14 by a guide 13 for fixation of the toner image on the transfer sheet P, whereafter the sheet P is discharged out of the copying apparatus body C by discharge rollers 15. Designated by T is a tray.

Reference numeral 16 designates the housing of a process unit U in which are mounted the photosensitive drum 3, the charger 4, the developing device 5, the cleaner 7 and the upper transfer guide 10. These constitute the process unit U. The process unit U has, in its housing 16, sliding portions $l_3$ and $l_4$ slidable on rails $l_1$ and $l_2$ provided on the copy apparatus upper body $C_1$ side. The sliding portions $l_3$ and $l_4$ are slidable on rails $l_1$ and $l_2$, whereby the unit U is removably mountable on the copying apparatus body. The unit U having reached a predetermined loaded position of the copying apparatus body is positioned and fixed by locking means which will hereinafter be described.

Figure 2:
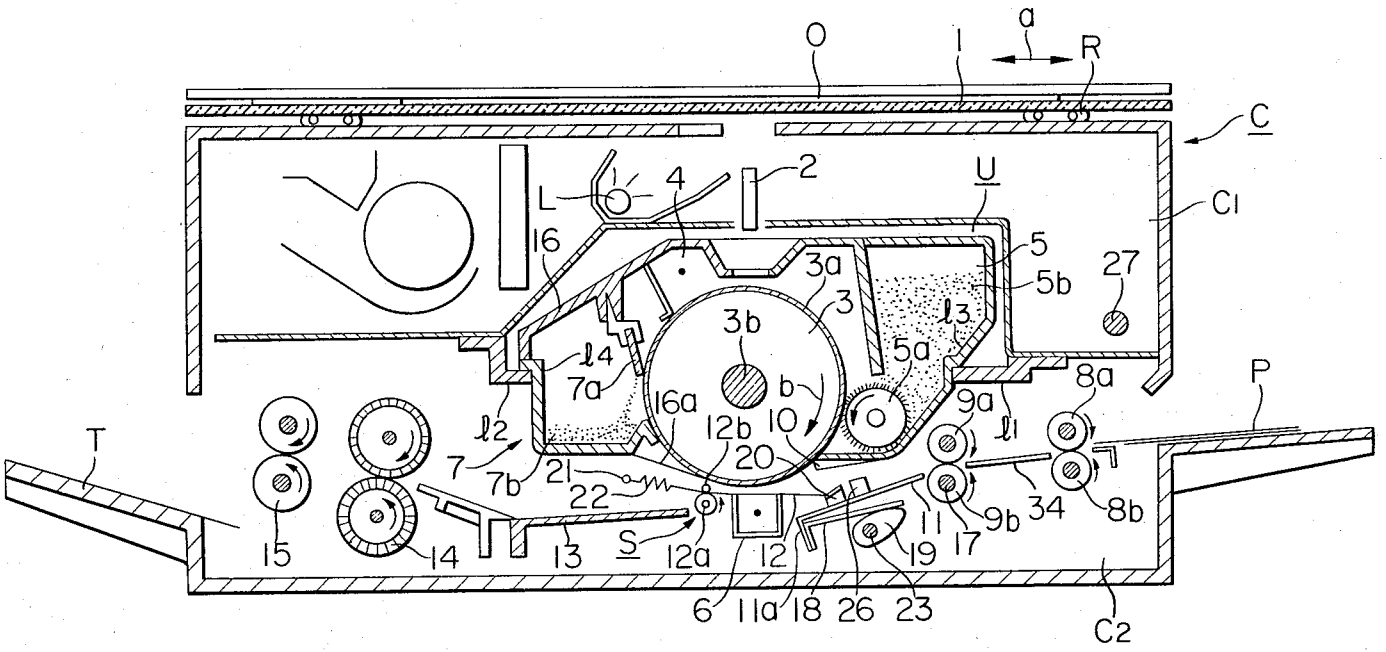

The separating belt 12 is mounted between a separating belt hanger 20 fixed at a position on the side edge portion of the lower transfer guide 11 which does not interfere with the conveyance of the sheet and a shaft 21 fixed to the lower body C2, through a spring 22 for providing a predetermined tension. As will later be described, the separating belt 12 can be brought from its operative position in which it bears against the photosensitive drum 3 to its retracted position in which it is spaced apart from the drum 3 as shown in FIG. 2, because the separating belt hanger 20 lowers as soon as the lower transfer guide 11 pivots downwardly.

Now, the lower transfer guide 11 guides the sheet P so that the sheet uniformly contacts the drum 3, and is provided on the copying apparatus lower body C2 side usually at a distance of 1–2 mm from the photosensitive drum 3 mounted at a predetermined position within the body, in order to prevent the toner image on the photosensitive drum from being scattered when it is transferred onto the sheet P. Therefore, if the mounting or dismounting of the drum is effected with the lower transfer guide 11 remaining mounted at a predetermined position, the drum 3 will be injured. For this reason, in the present embodiment, the lower transfer guide 11 is provided for pivotal movement about the shaft 17 of the lower register roller 9*b*, and a clockwise rotational force is imparted to the lower transfer guide 11 by a cam 19 through a plate spring 18 attached to the lower transfer guide 11. The position of the lower guide 11 relative to the photosensitive drum 3 is controlled by making the fore end 11*a* of the lower transfer guide 11 abut against the both side edge portions 16*a* of the housing 16 of the process unit U. The cam 19 is rotatable about a shaft 23 and, by rotating this cam 19 clockwisely as shown in FIG. 2, the lower transfer guide 11 may be pivoted counterclockwisely about a shaft 17 and lower away from the drum 3 into a position which does not affect the mounting or dismounting of the drum.

Figure 3:
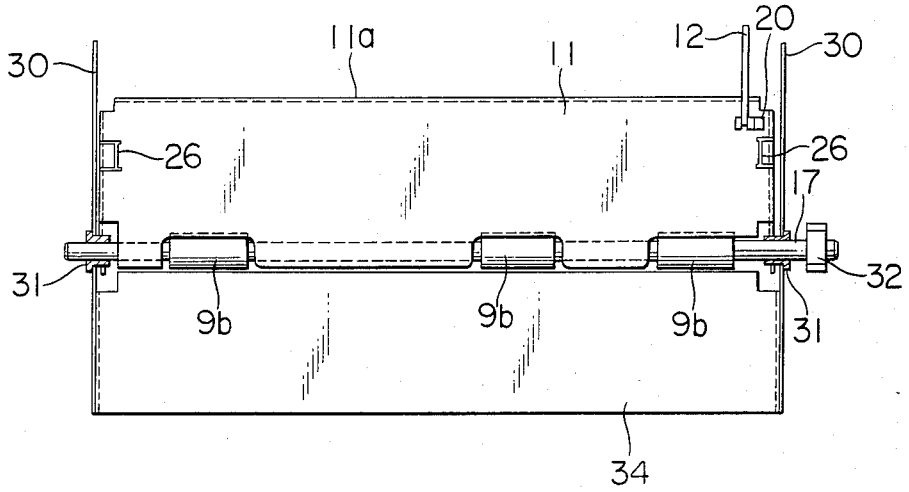
FIG. 3 is a plan view of a lower transfer guide.

FIG. 3 is a plan view showing the supported condition of the lower transfer guide 11.

In FIG. 3, the shaft 17 of the lower register roller 9*b* is rotatably supported on the side plate 30 of the body through a plain bearing 31 and is driven by receiving the drive from a drive source (not shown) by a gear 32. The lower transfer guide 11 is pivotally engaged with the outer peripheral portion of the plain bearing 31 and is pivotable about the shaft 17 of the register roller 9*b*. The separating belt 12, the separating belt hanger 20 and riser portions 26 will all be described later. Pivoting the lower transfer guide 11 about the shaft 17 of the register roller 9*b* by the rotational operation of the cam 19 can avoid the interference with the register roller when the lower transfer guide is released, and is also effective in making the apparatus compact. Moreover, in the present embodiment, the positioning of the lower guide 11 is effected by causing the fore end 11*a* of the lower guide 11 to bear against a contact portion integral with the drum 3, namely, the opposite side edge portions 16*a* of the housing 16 of the unit U and therefore, the spacing between the lower guide 11 and the drum 3 can be determined with good accuracy. Further, by simply rotating the cam 19, the lower guide 11 and the separating belt 12 can be positioned at or released from predetermined positions.

Further, in the present embodiment, locking or unlocking of the process unit U with respect to the predetermined loaded position of the apparatus body is effected in response to the operation of the cam 19. That is, setting or unsetting of the lower transfer guide 11 to its operative position and locking or unlocking of the process unit U at the predetermined loaded position of the apparatus body are effected at a time.

Figure 4:
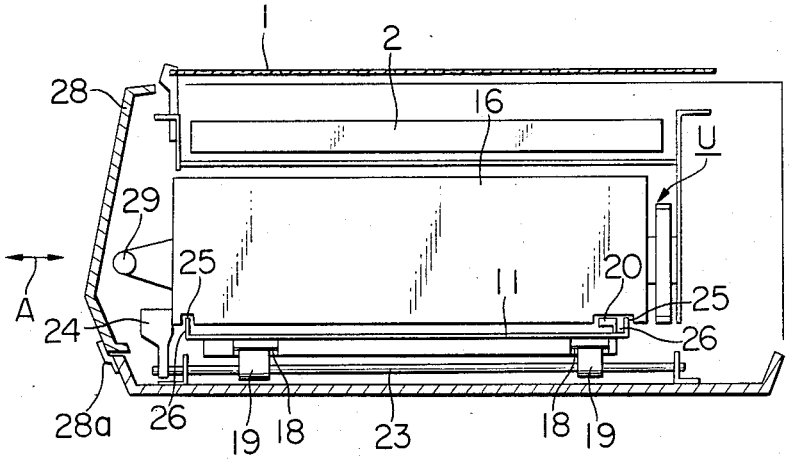
FIG. 4 is a side view showing the loaded condition of a process unit.

Reference is now had to FIG. 4.

The operation of loading the process unit U into the apparatus body will first be described.

In FIG. 4, the process unit U may be mounted or dismounted in the direction of arrow A by opening a front body cover 28 by pivoting it about a hinge 28*a*. Designated by 24 is a manually actuated operating lever integrally fixed to a shaft 23. The cam 19 is secured to the shaft 23. Denoted by 29 is the grip of the process unit U. Reference numeral 25 designates grooves provided in the housing 16 of the process unit U. The riser portions 26 provided on the opposite end portions of the lower transfer guide 11 fit in the grooves 25.

First, when the process unit U is to be mounted in the apparatus body, the operating lever 24 is clockwisely rotated, whereby the cam 19 rotates with the shaft 23. Thus, the plate spring 18 so far pushed up by the cam 19 is lowered. With this lowering of the plate spring 18, the lower transfer guide 11 pivots downwardly from gravity, with a result that the riser portions 26 become disengaged from the grooves 25 to unlock the unit U with respect to the body and the unit U retracts to its released position while, at the same time, the separating belt 12 also lowers and retracts from its operative position, whereupon there is brought about a condition in which the process unit U can slide on the sliding portions $l_1$ and $l_2$ of the body side and be inserted into the body. The process unit U is then caused to slide on the sliding portions $l_1$ and $l_2$ and forced into its predetermined loaded position in the body, whereafter the operating lever 24 is clockwisely rotated, whereby the cam 19 pushes up the plate spring 18, so that the lower transfer guide 11 is set to a transfer paper guiding position (i.e., an operative position) and the separating belt 12 comes to bear against the drum 3. At that time, the riser portions 26 provided on the lower transfer guide 11 are raised with the lower transfer guide 11 and fit in the grooves 25 of the process unit U, thereby locking the process unit U so that it does not slip out of the body. The riser portions 26 are located at locations deviated from the paper path. Alternatively, the riser portion 26 may be located on this side or only on one side. The riser portions 26 may be in the form of projections such as dowels.

When the unit U is to be removed from the body, the operating lever 24 may be clockwisely rotated, whereby unlocking of the unit U and retraction of the lower transfer guide 11 downwardly of the separating belt 12 may take place as described above to permit the unit U to be simply removed from the body.

As described above, according to the present embodiment, releasing of the transportation guide and unlocking of the process unit with respect to the body can be accomplished at a time and this leads to the provision of an image formation apparatus excellent in operability which is free of the danger of effecting mounting or dismounting of the process unit without releasing the transportation portion. Further, the separator means can also be mounted or dismounted with respect to the photosensitive drum at the same time and, where the developing device and cleaner are incorporated in the process unit, these units need not be released and therefore, mounting or dismounting of the process unit can be accomplished simply by releasing the transportation portion, namely, by a single operation. Conversely, if the transportation portion is set, locking of the process unit can be accomplished at the same time, and this leads to the possibility of making the operation of interchanging the process unit very simple by a simple mechanism, as well as to the provision of an image formation apparatus which is excellent in operability. Also, by securing the upper transfer guide integrally to the process unit and positioning the lower transfer guide by a positioning member on the process unit side, the positioning of the transportation guide relative to the photosensitive drum can be accomplished easily.

Figure 5:
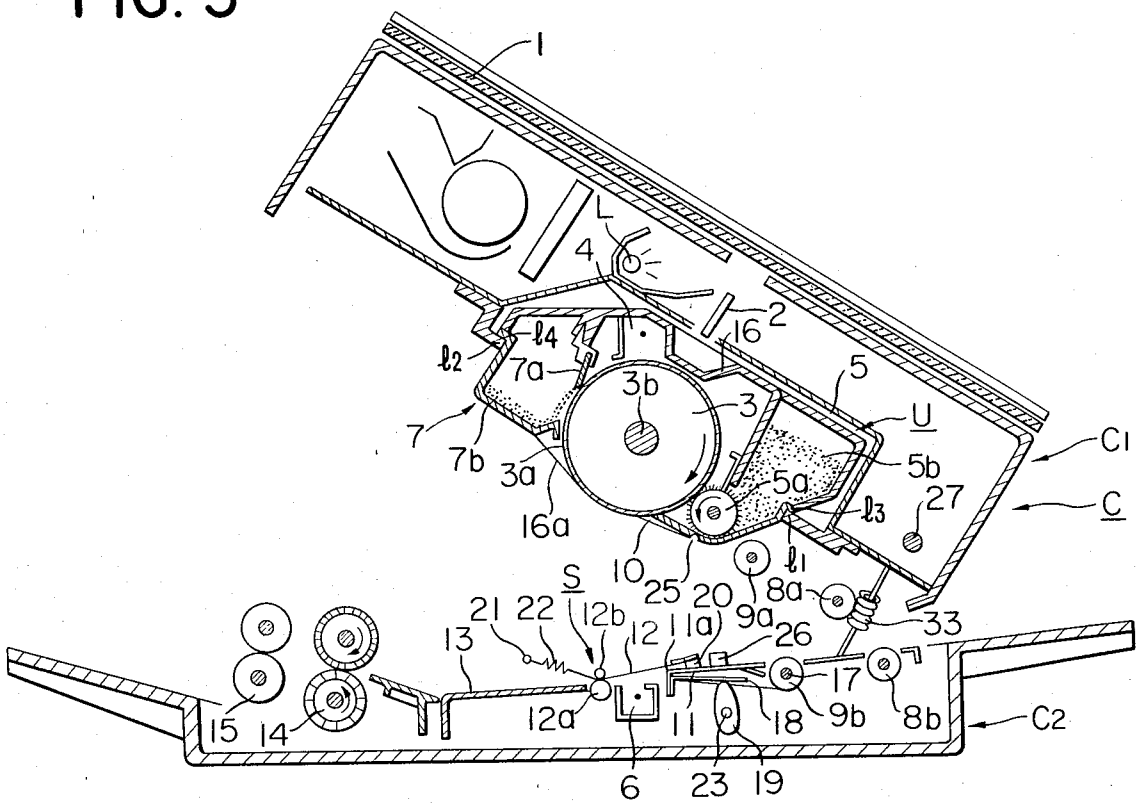
FIG. 5 is a cross-sectional view a condition in which the body of the FIG. 1 copying apparatus is opened.

Further, in the present embodiment, as shown in FIG. 5, the apparatus body is divided into an upper body C1 and a lower body C2 which may constitute first and second supports, respectively, to facilitate the maintenance of the apparatus, so that the apparatus body can be opened into the upper and lower bodies about a shaft 27. Designated by 33 is a push-up spring for pushing up the body C1 when the apparatus body is opened. The process unit U is provided in the upper body C1, and the lower transfer guide 11 and the separator means S including the separating belt 12, etc. are provided in the lower body C2. The upper and lower paper feeding rollers **8*a* and 8*b* and the upper and lower register rollers 9*a* and 9*b* are provided in the upper body C1 and the lower body C2, respectively. This facilitates jam treatment by opening the apparatus body with the transfer paper transportation path as the boundary during jam treatment. Thus, the drum 3 and the lower transfer guide 11 are separated into the upper body C1 and the lower body C2, but by positioning the lower transfer guide 11 in relation to the process unit U, it becomes possible to provide accuracy easily as compared with a case where the lower transfer guide 11 is positioned and fixed in the lower body C2. Also, by providing the upper transfer guide 10 integrally with the process unit U, it becomes possible to enhance the accuracy and the necessity of releasing the upper transfer guide during mounting or dismounting of the process unit is eliminated, thus facilitating jam treatment. Moreover, the unit U is pivoted upwardly by opening the upper and lower bodies C1 and C2 and therefore, the engagement between the grooves 25 provided in the housing 16 and the riser portions 26 of the lower guide 11** is released to permit the unit U to slide on the sliding portions $l_1$ and $l_2$ for removal of the unit.

That is, when the upper body C1 and the lower body C2 are opened, the lock of the unit U with respect to the body is released.

Figure 6:
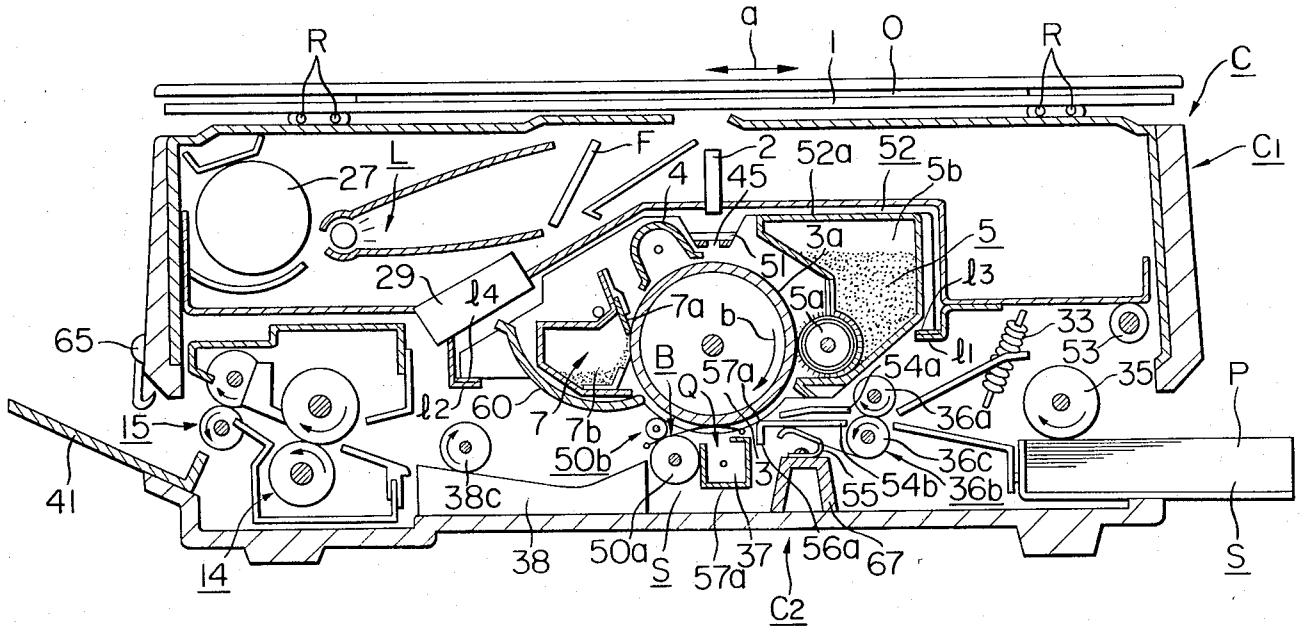
FIG. 6 is a cross-sectional view of a copying apparatus to which another embodiment of the present invention is applied.
Figure 7:
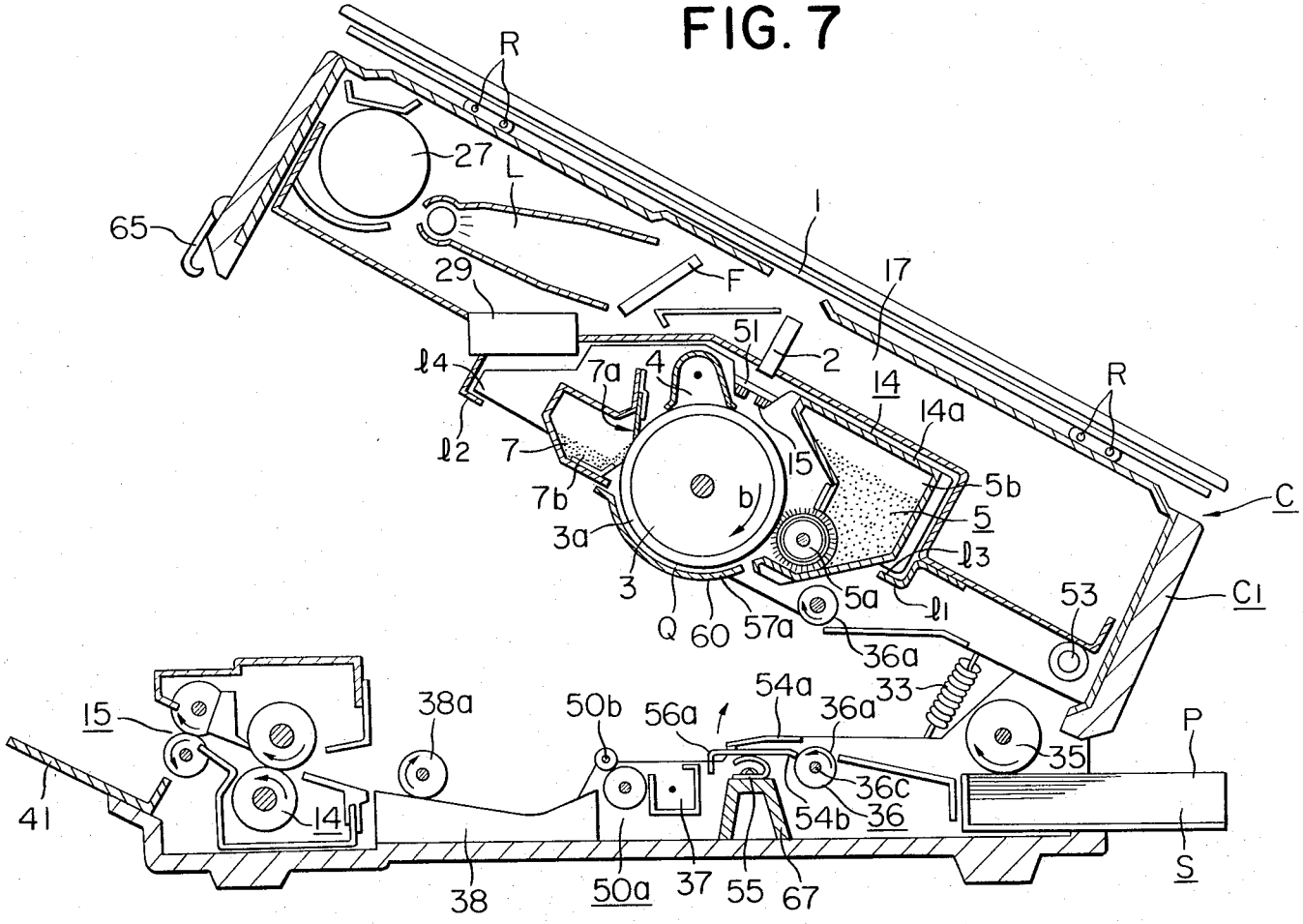
FIG. 7 is a cross-sectional view showing a condition in which the body of the FIG. 6 apparatus is opened.
Figure 8:
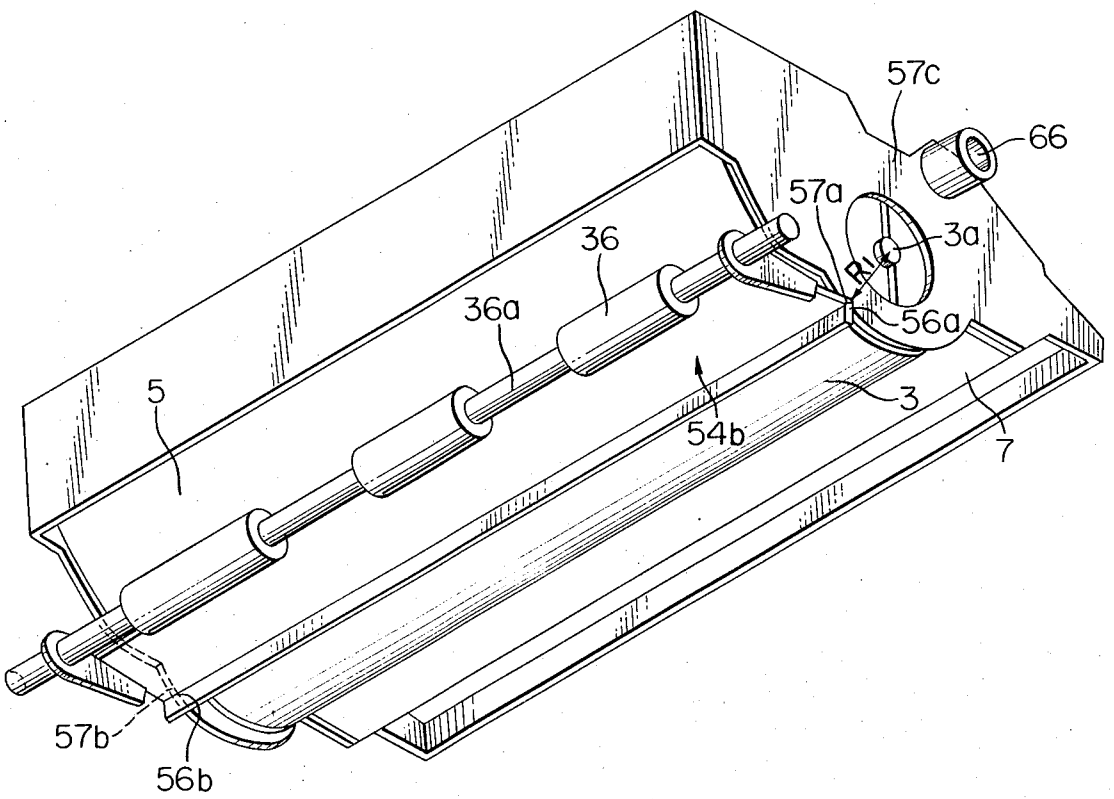
FIG. 8 is a perspective of the unit as seen from below it.

Another embodiment is shown in FIGS. 6, 7 and 8.

FIG. 6 shows a cross-sectional view of the copying apparatus body C. FIG. 7 is a cross-sectional view of the FIG. 6 copying apparatus body as it is opened, and FIG. 8 is a perspective view of the unit as seen from below it. In FIG. 6, reference numeral 1 designates an original carriage formed of a transparent material such as glass and reciprocable on rails R in the direction of arrow b. Designated by 2 is a short-focus small-diameter imaging element array. The image of an original O placed on the original carriage 1 is illuminated by an illuminating lamp L and the reflected optical image thereof is slit-projected upon a photosensitive drum 3 by the array 2. The photosensitive drum 3 is rotatable in the direction of arrow b about a shaft **3*b*. Reference numeral 4 denotes a charger for uniformly charging the photosensitive drum 3 covered with a photosensitive layer 3*a* of zinc oxide or organic semiconductor, for example. The drum 3 uniformly charged by the charger 4 is subjected to image exposure by the element array 2, whereby an electrostatic image is formed on the photosensitive drum 3. The electrostatic latent image is then developed into a visible image by a developing device 5 comprising a magnet roller 5*a* and a toner reservoir 5*b*. On the other hand, one of sheets P contained in a cassette S is fed to the drum 3 by a feed roller 35 and upper and lower register rollers 36*a* and 36*b* rotated in synchronism with the image on the ph-otosensitive drum 3. The toner image on the photosensitive drum 3 is transferred onto the sheet P by a transfer discharger 37. Thereafter, the sheet P is separated from the drum 3 by separator means S (for example, a separating belt B having its opposite ends secured to the lower body C1 side as shown, or a separating corona discharger), and then the sheet P is guided to a fixing device 14 by a guide 38 and a pinch roller 38*a* for fixation of the toner image on the sheet P, whereafter the sheet P is discharged onto a tray 41 by discharge rollers 15. After the transfer of the toner image, any toner remaining on the drum 3 is removed by a cleaner 7. The cleaner 7 comprises a blade 7*a* and a toner reservoir 7*b*. Reference numeral 50*a* designates a separating roller, and reference numeral 50*b* denotes a follower roller. F designates a heat absorbing filter. Denoted by 45 is a slit opening for directing the original image to the surface of the drum 3**.

In the present embodiment, the photosensitive drum 3 and the charger 4, the developing device 5, the cleaner 7 and a filter 51 disposed around the photosensitive drum 3 are provided as a unit and surrounded by a frame member 52*a* as a light-intercepting wall, and these constitute a process unit 52. This process unit 52 is provided so as to be removably mountable in the direction of the rotatable axis of the drum 3 with respect to the body C when the body is opened as will hereinafter be described. When it is mounted or dismounted with respect to the body, the process unit 52 is guided by the sliding portions $l_3$ and $l_4$ of the frame member 52*a* thereof being engaged with the guides $l_1$ and $l_2$ on the body side. The frame member 52 is formed of black rigid plastic, whereas this is not restrictive but the frame member may be metallic or wooden.

Now, the copying apparatus C, as shown in FIG. 7, is divided into an upper body C1 and a lower body C2 which are coupled by a pivot shaft 53. The upper body C1 is upwardly pivotable about the pivot shaft 53 by a spring 33. In the upper body C1, there are disposed the array 2 and lamp L as the illuminating optical system, and process means such as the photosensitive drum 3, developing device 5, cleaner 7, etc. Within the lower body C2, there are disposed a feed roller 35, transfer discharger 37, separator means S, guide 38 and fixing device 14 in the sheet transportation path. The sheet transportation path may be opened by pivoting the upper body C1 upwardly.

In the present embodiment, an upper guide 54*a* and a lower guide 54*b* for guiding toward the drum the sheet P fed by register rollers 36*a* and 36*b* in synchronism with the image on the drum 3 are provided within the lower body C2. The lower guide 54*b*, as in the previous embodiment, is pivotally mounted on the shaft 36*c* of the lower register roller 36*b*. The lower guide 54*b* is upwardly biased from the back thereof by a plate spring 55. In a position wherein the upper body C1 and the lower body C2 are closed together, namely, in the copying capable position, the lower guide 54*b* is positioned by the corners 56*a* and 56*b* of the fore end of the lower guide 54*b* striking against the lower portions 57*a* and 57*b* (contacting portions) of the side plates of the housing 52*a* of the unit 52 with the aid of the resilient force of the spring 55 (FIG. 8). In FIG. 8, reference numeral 66 designates a connector provided on the innermost side plate 57*c*. The plate spring 55 is mounted on a base 67.

Assuming that the distance from the axis of the drum shaft 3*b* to the lower portions 57*a*, 57*b* of the side plates against which the lower guide 54*b* strikes, namely, the contacting portions, is R, R = radius r of the drum 3 + the gap g between the lower guide 54*b* and the drum 3 and the distance R may be suitably selected so that the gap g may be optimum.

Figure 9:
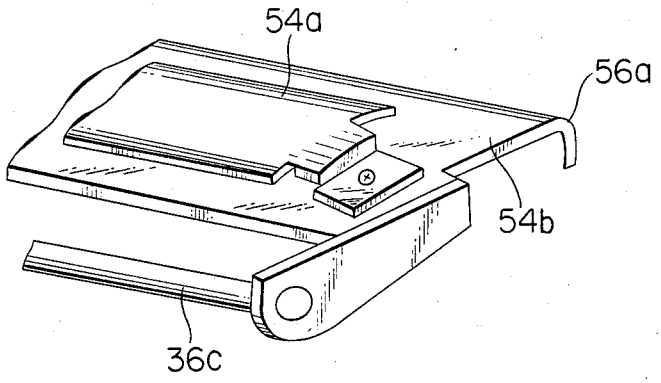
FIG. 9 is a perspective view of a transfer guide.

In the present embodiment, the upper guide 54*a* is secured to the lower guide 54*b* at the opposite ends thereof, as shown in FIG. 9. Therefore, by the lower guide 54*b* having the gap with respect to the drum 3 accurately positioned by the contacting portions 57*a* and 57*b* integral with the drum 3, the upper guide 54*a* is also accurately positioned.

Description will now be made of a case where the body C is opened to effect maintenance such as removal of the drum or jam treatment.

As shown in FIG. 7, the upper body C1 is pivoted upwardly about the shaft 53. Thereupon, the contacting portions 57*a* and 57*b* provided on the unit 52 become spaced apart from the corners 56*a* and 56*b* of the fore end of the lower guide 54*b*, and the lower guide 54*b* pivots upwardly within the range of resiliency of the plate spring 55 and stops at a predetermined position (FIG. 7). Thus, the body C is opened with the transportation path of sheet P as the boundary, thereby facilitating maintenance or the like.

When the body C is to be closed, the upper body C1 is pushed down, whereby the contacting portions 57*a* and 57*b* of the upper body C1 bear against the corners 56*a* and 56*b* of the lower guide to push down them against the resilient force of the plate spring 55 and the upper body C1 and the lower body C2 are locked at a predetermined position by locking means 65, whereupon the gap between the peripheral surface of the drum 3 and the fore end of the lower guide 54*b* can be maintained accurately.

Designated by 60 is a cover for shielding the exposed surface of the drum 3 from light and protecting such surface. The cover 60 is provided integrally with and below the process unit 52. The cover 60 is formed of black rigid plastic of the same quality as the frame member 52, for example, ABS resin, and is curved and shields the surface of the photosensitive drum 3 from light as well as prevents such surface from being injured or damaged.

In the first-described embodiment, a fixing member provided integrally with the lower transfer guide has been used to fix the process unit, but the process unit may also be fixed by an operating lever for releasing the transfer guide. Also, in the first-described embodiment, release of the separating belt is effected, whereas this is not restrictive but, for example, the same procedure as in the second-described embodiment may be adopted.

Although, in the present embodiment, the image bearing member has been shown as being provided with a photosensitive layer of organic semiconductor or zinc oxide, the present invention is not restricted thereto but it is apparent that other photosensitive layer may also be used. Further, in the present invention, the image bearing member is not restricted to one using a photosensitive layer, but it is apparent that use may also be made of an image bearing member using an insulating layer or the like. The shape of the image bearing member is not restricted to the drum shape, but for example, an endless belt passed over pulleys may also be used.

The present invention is not restricted to the magnetic brush development, but a developing system such as the cascade development, the fur brush development or the powder cloud development is applicable.

The cleaning system is neither restricted to the blade cleaning, but the fur brush cleaning, the roller cleaning or the web cleaning is applicable.

Further, the imaging element is not restricted to the short-focus small-diameter imaging element array, but for example, a customary lens or a bar lens may also be used.

The process for image formation is restricted in no way, but for example, the Carlson system, the NP system (U.S. Pat. No. 3,666,363) or the PIP system is also applicable.

Figure 10A:
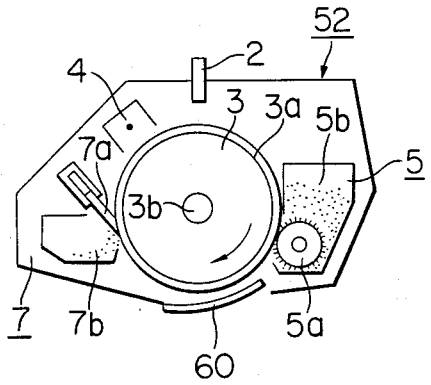
FIGS. 10A–10G are schematic views of various units.
Figure 10B:
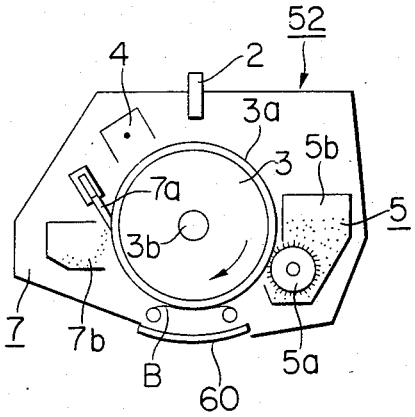
Figure 10C:
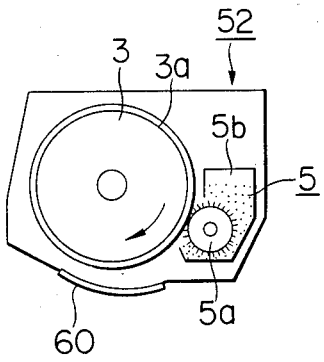
Figure 10D:
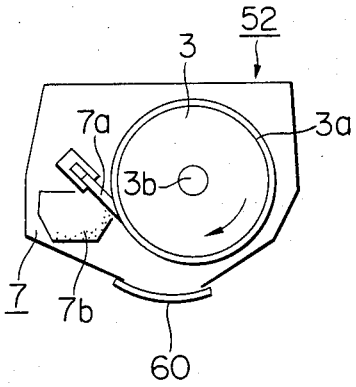
Figure 10E:
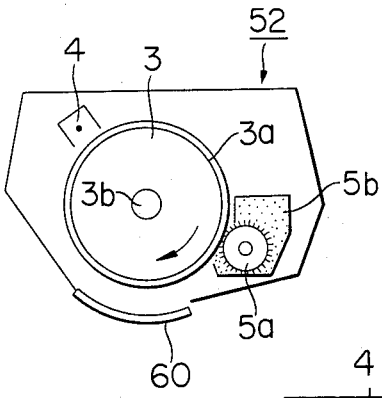
Figure 10F:
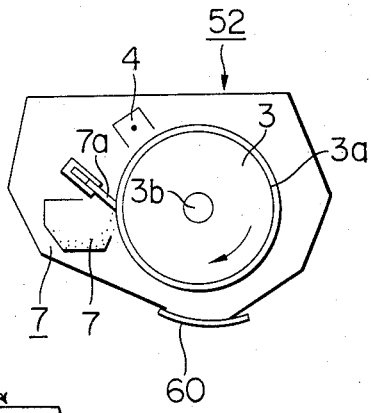
Figure 10G:
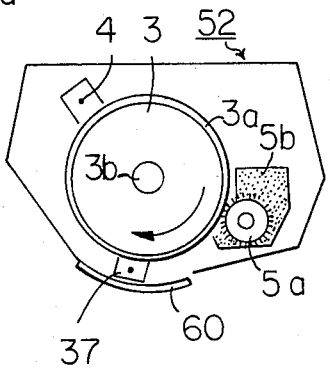

In the present embodiment, the process unit has been shown as having incorporated therein a photosensitive drum and process means such as a developing device, a cleaner, a charger, etc., whereas the present invention is not restricted thereto. For example, as schematically shown in FIGS. 10A–G, the array 2, charger 4, developing device 5 and cleaner 13 as the process means, together with the photosensitive drum 3, may be incorporated in the unit 52 (FIG. 10A). Further, the separator means B may be integrally incorporated (FIG. 10B). Also, the developing device 5 and the photosensitive drum 3 (FIG. 10C), the cleaner 7 and the photosensitive drum 3 (FIG. 10D), the charger 4, the developing device 5 and the photosensitive drum 3 (FIG. 10E), the charger 4, the cleaner 7 and the photosensitive drum 3 (FIG. 10F) or the charger 4, developing device 5, transfer discharger 37 and the photosensitive drum 3 (FIG. 10G) may be integrally incorporated. The image bearing member is not restricted to the photosensitive drum 3, as previously described. That is, the process unit 52 may include the image bearing member and some or all of the process means. In the present embodiment, the process means acting on the image bearing member is the array 2, the charger 4, the developing device 5, the transfer discharger 37, the separator means S or the cleaner 7. In FIGS. 10A–G, examples having the cover 60 are shown, whereas the cover 60 should only be present depending on the nature of the photosensitive layer and is not indispensable. The process means held by the unit may be removable with respect to the unit.

As described above, the present invention improves the operability of an image formation apparatus having an image bearing member and process means acting on the image bearing member.

What I claim is:

1. An image formation apparatus having:

an image bearing member;

process means for acting on said image bearing member;

a process unit including said image bearing member and said process means and removable and totally separable from a body of said apparatus;

movable guide means for guiding a transported sheet toward said image bearing member; and support means for supporting said movable guide means so as to position said guide means in relation to said process unit when said process unit is mounted in an operative position.

2. An image formation apparatus according to claim 1, wherein said support means has a spring.

3. An image formation apparatus according to claim 1, wherein said movable guide means is disposed on the body of said apparatus.

4. An image formation apparatus according to claim 1, wherein said support means is disposed on the body of said apparatus.

5. An image formation apparatus according to claim 1, wherein said guide means is urged by an elastic member to contact said process unit.

6. An image formation apparatus having a body dividable into a first support and a second support adapted to be opened and closed relation to one another, said first support being provided with an image bearing member, process means for acting on said image bearing member, and a contacting portion adjacent said image bearing member, said second support being provided with guide means for guiding a transported sheet toward said image bearing member, and support means for movably supporting said guide means, said guide means provided in said second support being positioned by said contacting portion provided in said first support when said first support and said second support are closed.

7. An image formation apparatus according to claim 6, wherein said contacting portion is the frame member of said process unit.

8. An image formation apparatus having a body dividable into a first support and a second support adapted to be opened and closed relative to one another, said apparatus having:

an image bearing member;

process means for acting on said image bearing member;

a process unit having said image bearing member and said process means, and removably mountable on the body of said apparatus; and locking means for positioning said process unit with respect to said body so that the lock of said process unit with respect to said body is released when said first support and said second support are opened.

9. An image formation apparatus according to claim 8, wherein said locking means has a riser portion.

10. An image formation apparatus having:

an image bearing member;

process means for acting on said image bearing member;

a process unit having said image bearing member and said process means removably mountable on a body of said apparatus;

movable guide means for guiding a transported sheet toward said image bearing member when in an operative position; and operating means for effecting the locking of said process unit to its mounted position in the body of said apparatus and the setting of said guide means to its operative position.

11. An image formation apparatus according to claim 10, wherein said operating means has a lever.

12. An image formation apparatus according to claim 10, wherein said operating means has a cam.

13. An image formation apparatus according to claim 1, 6, 8 or 10, wherein said process means has a developing device.

14. An image formation apparatus according to claim 1, 6, 8 or 10, wherein said process means has a short-focus small-diameter imaging element array.

15. An image formation apparatus according to claim 1, 6, 8 or 10, wherein said process means has a charger.

16. An image formation apparatus according to claim 1, 6, 8 or 10, wherein said process means has a cleaner.

17. An image formation apparatus according to claim 1, 6, 8 or 10, wherein said process means has separator means.

18. An image formation apparatus according to claim 1, 6, 8 or 10, wherein said process means has a transfer discharger.

19. An image formation apparatus according to claim 1, 8 or 10, wherein said process unit has the image bearing member, a developing device, a cleaner and a charger.

20. An image formation apparatus according to claim 1, 8 or 10, wherein said process unit has the image bearing member, a developing device, a cleaner, a charger and an array.

21. An image formation apparatus according to claim 1, 8 or 10, wherein said process unit has the image bearing member, a developing device, separator means, a cleaner and a charger.

22. An image formation apparatus according to claim 1, 8 or 10, wherein said process unit has the image bearing member and a developing device.

23. An image formation apparatus according to claim 1, 9 or 10, wherein said process unit has the image bearing member and a cleaner.

24. An image formation apparatus according to claim 1, 8 or 10, wherein said process unit has the image bearing member, a developing device and a charger.

25. An image formation apparatus according to claim 1, 8 or 10, wherein said process unit has the image bearing member, a cleaner and a charger.

26. A process unit removably mountable to a body of an image formation apparatus, comprising:

an image bearing member:

process means for acting on said image bearing member;

support means for supporting said image bearing member and said process means; and a contacting portion for contacting a positioning portion of movable guide means for guiding a transported sheet, said movable guide means being disposed on the body of the apparatus.

27. A process unit according to claim 26, wherein said process means has a developing device.

28. A process unit according to claim 26, wherein said process means has a charger.

29. A process unit according to claim 26, wherein said process means has a short-focus small-diameter imaging element array.

30. A process unit according to claim 26, wherein said process means has a cleaner.

31. A process unit according to claim 26, wherein said process means has separator means.

32. A process unit according to claim 26, wherein said process means has a transfer discharger.

33. A process unit according to claim 26, wherein said contacting portion is a portion of said support means.

34. An image formation apparatus comprising:

(a) a process unit removably mountable to a body of an image formation apparatus, having an image bearing member;

process means for acting on said image bearing member;

support means for supporting said image bearing member and said process means; and a contacting portion; and (b) guide means movably disposed on the body of the apparatus for guiding a transfer sheet to a transfer portion of the process unit when said guide means is set in a predetermined setting position in the body of the apparatus:

said contacting portion of the process unit contacting a positioning portion of said guide means so as to position said guide means in the predetermined setting position for guiding the transfer sheet.

35. A process unit removably mountable to a body of an image foramtion apparatus, comprising:

an image bearing member;

process means for acting on said image bearing member;

support means for supporting said image bearing member and said process means; and a transfer sheet guiding portion for guiding a transfer sheet to a transfer portion of the image bearing member of the process unit, said guide portion being set in a predetermined setting position in the body of the apparatus when the process unit is set in the body of the apparatus.

36. A process unit removably mountable to a body of an image formation apparatus, comprising:

an image bearing member;

process means for acting on said image bearing member;

support means for supporting said image bearing member and said process means;

a contacting portion for contacting a positioning portion of movable guide means disposed on the body of said apparatus;

a transfer sheet guiding portion for guiding a transfer sheet to a transfer portion of the process unit when said guide portion is set in a predetermined setting position in the body of the apparatus.

37. A process unit according to claim 36, wherein said contacting portion and said transfer sheet guiding portion are disposed on the support means.

38. A process unit according to claim 36, wherein said guide means is urged by an elastic member to contact said contacting portion.

39. An image formation apparatus comprising:

(a) a process unit removably mountable to a body of an image formation apparatus, having:

an image bearing member:

process means for acting on said image bearing member;

support means for supporting said image bearing member and said process means;

a contacting portion; and a transfer sheet guiding portion for guiding a transfer sheet to a transfer portion of the process unit when said guiding portion is at a predetermined setting position in the body of the apparatus; and (b) guide means movably disposed on the body of the apparatus for guiding the transfer sheet to the transfer portion of the image bearing member of the process unit when said guide means is set in the predetermined setting position in the body of the apparatus;

said contacting portion of the process unit contacting a positioning portion of said guide means so as to position the guide means in the predetermined setting position for guiding the transfer sheet.

40. An image formation apparatus according to claim 39, wherein said contacting portion and said transfer sheet guiding portion are disposed on the support means.

41. An image formation apparatus comprising:

a body device having a first housing for supporting the whole apparatus;

a second housing openable and closeable relative to the first housing and holding a process unit detachably; and guide means movably disposed on a body of the apparatus for guiding a transfer sheet to a transfer portion of the process unit which is set in a predetermined setting in the body of the apparatus; and the process unit having the image bearing member;

process means for acting on the surface of the image bearing member;

support means for supporting the image bearing member and the process means; and a contacting portion for contacting a positioning portion of movable guide means disposed on the body of said apparatus;

said contacting portion of the process unit contacting the positioning portion of the guide means movably disposed on the body of the apparatus when both housings are closed relative to each other so as to position the guide means in a predetermined position for guiding the transfer sheet.

42. An image formation apparatus according to claim 41, wherein said guide means is disposed on the first housing and said process unit is removably mounted on the second housing.

43. An image formation apparatus comprising:

a first housing for supporting the whole apparatus;

a second housing openable and closable relative to the first housing;

an image bearing member;

process means for acting on the surface of the image bearing member;

guide means movably disposed for guiding a transfer sheet to a transfer portion at which the image is transferred from the image bearing member to a transfer sheet when said guide means is set in a predetermined setting position in a body of the apparatus; and a contacting portion disposed to contact a positioning portion of said guide means;

said contacting portion contacting the positioning portion of the guide means when both housings are closed relative to each other so as to position the guide means in the predetermined setting position for guiding the transfer sheet.

44. An image formation apparatus according to claim 43, wherein said guide means is disposed on the first housing and said contacting portion is disposed on the second housing.

45. An image formation apparatus according to claim 34 or 43, wherein said guide means is urged by an elastic member to contact said contacting portion.

46. An image formation apparatus comprising:

a process unit setting portion disposed at a predetermined position in the apparatus body for removably supporting a process unit comprising an image bearing member, process means for acting on said image bearing member, and support means for supporting the image bearing member and the process means; and a transfer sheet guide movably mounted on the apparatus body for guiding a transfer sheet to a transfer portion of the process unit;

a transfer sheet guiding portion disposed on said process unit for guiding the transfer sheet to the transfer portion of the process unit cooperating with said transfer sheet guide disposed on the apparatus body to guide the transfer sheet to the transfer portion of the process unit.

47. An image formation apparatus having:

an image bearing member;

process means for acting on said image bearing member;

a process unit including said image bearing member and said process means removable and totally separable from a process unit setting portion disposed inside of the apparatus body;

movable guide means for guiding a transported sheet toward said image bearing member;

support means for supporting said movable guide means so as to position said guide means in relation to said process unit when said process unit is mounted in an operative position;

image forming means for forming on said image bearing member an image corresponding to image information;

transfer means for transferring the image formed by means of said image forming means on the image bearing member onto a sheet; and fixing means for fixing the image transferred onto the sheet by means of said transfer means.

* * * * *